US009823004B2

(12) United States Patent
Choi et al.

(10) Patent No.: US 9,823,004 B2
(45) Date of Patent: Nov. 21, 2017

(54) REFRIGERATOR AND METHOD FOR CONTROLLING THE SAME

(71) Applicant: LG Electronics Inc., Seoul (KR)

(72) Inventors: Byoungsuk Choi, Seoul (KR); Jinseok Hu, Seoul (KR); Heesun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 551 days.

(21) Appl. No.: 14/509,284

(22) Filed: Oct. 8, 2014

(65) Prior Publication Data

US 2015/0226475 A1 Aug. 13, 2015

(30) Foreign Application Priority Data

Feb. 7, 2014 (KR) ..... 10-2014-0014009

(51) Int. Cl.
*F25D 29/00* (2006.01)
*F25B 49/02* (2006.01)

(52) U.S. Cl.
CPC ..... *F25B 49/02* (2013.01); *F25D 29/00* (2013.01); *F25B 2500/05* (2013.01); *F25B 2600/01* (2013.01); *F25B 2700/00* (2013.01); *F25D 2600/02* (2013.01); *F25D 2700/02* (2013.01); *F25D 2700/12* (2013.01); *F25D 2700/14* (2013.01)

(58) Field of Classification Search
CPC ..... F25B 2600/01; F25B 2700/00; F25B 2500/05; F25B 49/02; F25B 2700/14; F25D 29/00; F25D 2700/12; F25D 2600/02; F25D 2700/02
See application file for complete search history.

(56) References Cited

U.S. PATENT DOCUMENTS 5,315,835 A * 5/1994 Park ..... F25D 21/006 62/153
5,483,804 A * 1/1996 Ogawa ..... F25D 21/006 62/153
5,806,321 A * 9/1998 Bendtsen ..... F25D 21/008 62/155

(Continued)

FOREIGN PATENT DOCUMENTS

EP 2251623 A1 11/2010

*Primary Examiner* — Kun Kai Ma
(74) *Attorney, Agent, or Firm* — Dentons US LLP

(57) ABSTRACT

A refrigerator and a method for controlling the same are disclosed. A refrigerator includes a timer for measuring an interval of one hour after power is supplied to the refrigerator, a door opening/closing sensor for sensing opening and closing of a door, a storage unit for storing information whether door is opened in a sector defined as one hour by the timer and at least 7 sector units each having 24 consecutive sectors, and a control unit for predicting a refrigerator use pattern in 24 sectors by overlapping 7 sector units, performing a normal operation mode to maintain a storage compartment at a first desired temperature in a sector in which door opening is predicted, and performing a power-saving operation mode to maintain the storage compartment at a second desired temperature higher than the first desired temperature in a sector in which door opening is not predicted.

17 Claims, 5 Drawing Sheets

(56) References Cited

U.S. PATENT DOCUMENTS

| | | | | |
|---|---|---|---|---|
| 2004/0050075 | A1* | 3/2004 | King | F25D 29/00 62/131 |
| 2005/0177282 | A1* | 8/2005 | Mason | G07F 9/105 700/300 |
| 2008/0077275 | A1* | 3/2008 | Merwarth | F25D 29/00 700/240 |
| 2008/0115516 | A1* | 5/2008 | Pimentel | F25D 29/00 62/229 |
| 2010/0070434 | A1* | 3/2010 | Cooper | G06Q 50/06 705/412 |

* cited by examiner

REFRIGERATOR AND METHOD FOR CONTROLLING THE SAME

This application claims the benefit of Korean Patent Application No. 10-2014-0014009, filed on Feb. 7, 2014, which is hereby incorporated by reference as if fully set forth herein.

BACKGROUND OF THE INVENTION

Field of the Invention

The present invention relates to a refrigerator and a method for controlling the same and, more particularly, to a refrigerator and a method for controlling the same capable of controlling a temperature in a storage compartment for the next 24 hours based on the recent refrigerator use pattern of a user.

Discussion of the Related Art

In general, a refrigerator is an apparatus for keeping food fresh during a certain period by cooling storage compartments (freezing compartment or refrigerating compartment) using a cooling cycle.

Such a refrigerator includes a compressor for compressing a refrigerant to high temperature and high pressure circulating through the cooling cycle. The refrigerant compressed in the compressor generates cool air via a heat exchanger, and the generated cool air is supplied to the freezing compartment or the refrigerating compartment.

In a conventional refrigerator, the compressor may be repeatedly turned on/off according to a temperature value in the refrigerator. When the temperature value in the refrigerator is greater than a predetermined temperature, the compressor is turned on to drive the cooling cycle. When the temperature value in the refrigerator is less than a predetermined temperature, the compressor is turned off because cool air supply is not needed.

Recently, research on a refrigerator capable of reducing energy consumption has been carried out.

SUMMARY OF THE INVENTION

Accordingly, the present invention is directed to a refrigerator and a method for controlling the same that substantially obviate one or more problems due to limitations and disadvantages of the related art.

An object of the present invention is to provide a refrigerator and a method for controlling the same capable of predicting a refrigerator use pattern based on a recent use pattern.

Another object of the present invention is to provide a refrigerator and a method for controlling the same capable of reducing power consumption of a refrigerator based on a refrigerator use pattern of a user.

A further object of the present invention is to provide a refrigerator and a method for controlling the same capable of estimating whether a time zone corresponding to a specific use pattern is daytime or nighttime and obtaining information about seasons based on a refrigerator use pattern and external information.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object and other advantages and in accordance with the purpose of the invention, as embodied and broadly described herein, a method for controlling a refrigerator includes: sensing door opening by a unit time after a point of time at which power is supplied to a refrigerator; storing information obtained from the sensing by the unit time for 168 hours; and dividing the information stored by the unit time for 168 hours by an interval of 24 hours into 7 units and combining the 7 units into one unit by overlapping the 7 units, wherein a time zone in which door opening does not occur is checked by the unit time in the one unit, and a refrigerator control temperature is controlled to be maintained higher than a temperature set by a user in the time zone in which door opening does not occur for 24 hours.

If time zones in which door opening occurs are consecutively arranged in the one unit, the refrigerator control temperature may be controlled below a temperature set by a user one hour before the time zone in which door opening is started.

If time zones in which door opening does not occur are consecutively arranged in the one unit, a refrigerating compartment control temperature may be controlled to 6° C. or more after the first time zone in which door opening does not occur.

The unit time may be defined by a sector having an interval of one hour. With respect to a sector in which door opening does not occur in the one unit, it may be predicted that there is a low possibility of door opening in the corresponding time zone. With respect to a sector in which door opening occurs in the one unit, it may be predicted that there is a high possibility of door opening in the corresponding time zone.

A storage compartment may be maintained at a first desired temperature in the sector in which door opening is predicted, and the storage compartment may be maintained at a second desired temperature higher than the first desired temperature in the sector in which door opening is not predicted.

The method may further include measuring a temperature of the atmosphere, wherein, if the measured temperature is 30° C. or more for a predetermined time, the second desired temperature may be lowered below a predetermined temperature.

If door opening is predicted in consecutive sectors more than a predetermined number, it may be determined that time zone corresponding to the consecutive sectors is daytime, and the measuring may include comparing a temperature measured in the sectors corresponding to the daytime with a predetermined temperature.

The method may further include measuring a temperature of the atmosphere, wherein, if the measured temperature is 20° C. or less for a predetermined time, the second desired temperature may be raised above a predetermined temperature.

If a ratio of the sectors in which door opening is predicted is greater than a predetermined value, the second desired temperature may be lowered below a predetermined temperature.

If a ratio of the sectors in which door opening is predicted is less than a predetermined value, the second desired temperature may be raised above a predetermined temperature.

The first desired temperature may be an inner temperature of the storage compartment set by a user.

In another aspect of the present invention, a refrigerator includes: a timer for measuring a unit time interval of one hour after a point of time at which power is supplied to the refrigerator; a door opening/closing sensor for sensing opening and closing of a door; a storage unit for storing information about door opening by the unit time for 168 hours; and a control unit for dividing the information stored by the unit time for 168 hours by an interval of 24 hours into 7 units, combining the 7 units into one unit by overlapping the 7 units, checking a time zone in which door opening does not occur by the unit time in the one unit, and controlling a refrigerator control temperature to be maintained higher than a temperature set by a user in the time zone in which door opening does not occur for 24 hours.

If time zones in which door opening occurs are consecutively arranged in the one unit, the control unit may control the refrigerator control temperature to be below a temperature set by a user one hour before the time zone in which door opening is started.

If time zones in which door opening does not occur are consecutively arranged in the one unit, the control unit may control a refrigerating compartment control temperature to be 6° C. or more after the first time zone in which door opening does not occur.

The unit time may be defined by a sector having an interval of one hour. With respect to a sector in which door opening does not occur in the one unit, the control unit may predict that there is a low possibility of door opening in the corresponding time zone. With respect to a sector in which door opening occurs in the one unit, the control unit may predict that there is a high possibility of door opening in the corresponding time zone.

A storage compartment may be maintained at a first desired temperature in the sector in which door opening is predicted, and the storage compartment may be maintained at a second desired temperature higher than the first desired temperature in the sector in which door opening is not predicted.

If door opening is not predicted in consecutive sectors more than a predetermined number, the control unit may determine that time zone corresponding to the consecutive sectors is nighttime.

The control unit may raise the second desired temperature above a predetermined temperature during the time zone corresponding to the consecutive sectors.

As is apparent from the above description, since a relatively small amount of data generated by short-term information collection is stored and used, a cost associated with data processing may be reduced. In other words, because refrigerator use information collected only for a week, i.e., 7 days is used, the amount of information about refrigerator use pattern may be reduced, and accordingly data management may be facilitated.

Further, since the refrigerator operation control for the next day is carried out based on the information collected for the past week, control with respect to an unexpected situation (for example, a situation in which a user is away from home on business for a long period) may be actively achieved. In other words, since prediction control information is updated daily, prediction control with respect to an unexpected situation may be achieved more rapidly than long-term prediction control based on refrigerator use information collected for a long period.

According to the present invention, by sufficiently cooling food stored in the storage compartment before a user opens the door, deterioration of freshness of food due to door opening may be minimized.

According to the present invention, a refrigerator use pattern in the future may be predicted based on a recent use pattern.

Further, power consumption of the refrigerator may be reduced and thus energy efficiency may be improved by using the predicted use pattern.

Further, although not receiving information about absolute time from an external device, it may be estimated whether a time zone corresponding to a specific use pattern is daytime or nighttime, and information about seasons may be obtained based on a refrigerator use pattern and external information.

According to the present invention, in the case in which the door is not opened for two hours or more, it is determined that nighttime begins, and the refrigerating compartment control temperature is set to be as high as possible to reduce operation time of the compressor, so as not to disturb a user's sleep.

Further, since a relative time counted after power is supplied to the refrigerator is used, there is no inconvenience of setting time.

Further, since only the door opening/closing data in the respective sectors overlap, data processing and store management may be easily achieved.

In addition, even when the power-saving operation mode is carried out, the temperature is additionally adjusted in consideration of various variables, thereby keeping food fresh longer and improving energy efficiency of the refrigerator.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
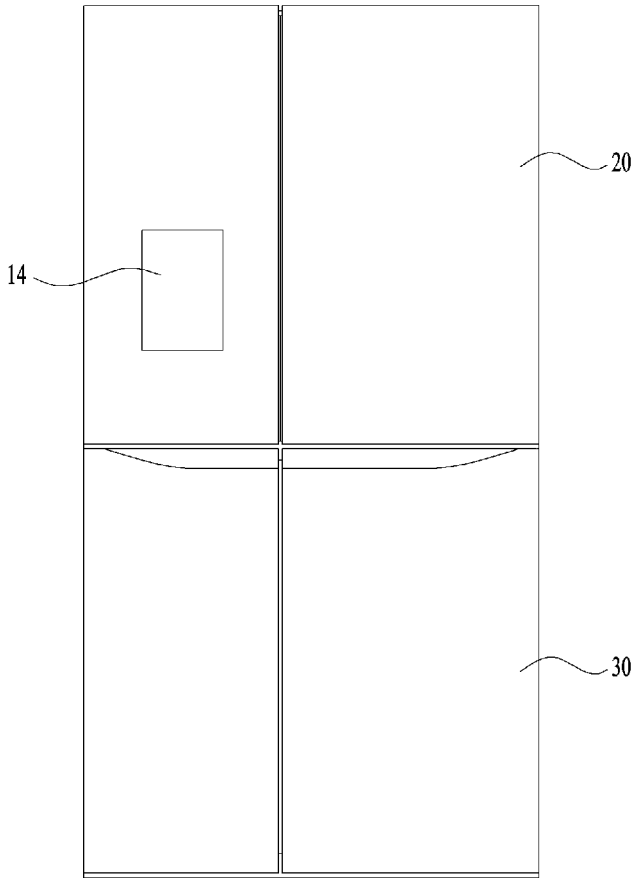
FIG. 1 is a front view of a refrigerator according to the present invention.

Reference will now be made in detail to the preferred embodiments of the present invention, examples of which are illustrated in the accompanying drawings.

In the drawings, the component's size, shape, etc. are exaggerated for clarity and convenience. Although most terms used in the present invention have been selected from general ones widely used in the art, some terms have been arbitrarily selected by the applicant and their meanings are explained in detail in the following description as needed. Thus, the present invention should be understood with the intended meanings of the terms rather than their simple names or meanings.

FIG. 1 is a front view of a refrigerator according to the present invention. The present invention will now be described with reference to FIG. 1.

A refrigerator according to the present invention can be applied to a top mount type refrigerator having food storage compartments including a freezing compartment and a refrigerating compartment partitioned up and down (i.e., the freezing compartment is disposed on the refrigerating compartment), and a side by side type refrigerator having a freezing compartment and a refrigerating compartment partitioned left and right.

However, for convenience of explanation, preferred embodiments of the present invention will be explained with reference to a bottom freezer type refrigerator having a refrigerating compartment and a freezing compartment partitioned up and down (i.e., the freezing compartment is disposed under the refrigerating compartment).

A main body of the refrigerator includes an outer case defining an outer appearance of the refrigerator and an inner case defining the storage compartments for storing food therein. A predetermined space between the outer case and the inner case may be formed with a passage through which cool air circulates.

The main body of the refrigerator further includes a machine room (not shown) in which a refrigerant cycle device for generating cool air by circulating the refrigerant is mounted. By maintaining the interior of the refrigerator at a low temperature using the refrigerant cycle device, freshness of food stored in the refrigerator is maintained. The refrigerant cycle device includes a compressor for compressing refrigerant, and an evaporator for phase-converting refrigerant liquid into refrigerant gas to perform heat exchange with the atmosphere.

The refrigerator includes doors 20 and 30 for opening and closing the storage compartments. The doors may include a freezing compartment door 30 and a refrigerating compartment door 20. The doors may be swingably mounted to the main body of the refrigerator by means of hinges connecting end portions of the doors to the main body. The freezing compartment door 30 and the refrigerating compartment door 20 may be provided in plural. The refrigerating compartment door 20 and the freezing compartment door 30 may be mounted to be opened forward about both side edges of the main body.

The door 20 may be provided with a panel unit 14 for providing a user with information about the refrigerator or receiving information about the refrigerator. A user may obtain information displayed on the panel unit 14 or adjust a temperature in the storage compartments of the refrigerator through the panel unit 14.

Figure 2:
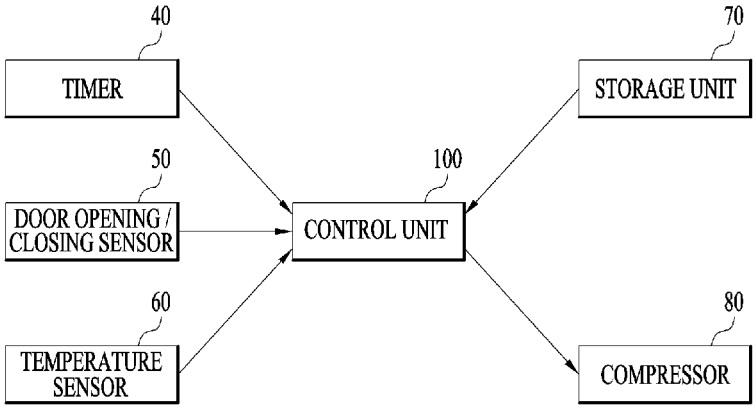
FIG. 2 is a control block diagram of a refrigerator according to one embodiment of the present invention.

FIG. 2 is a control block diagram of a refrigerator according to one embodiment of the present invention. The present invention will now be described with reference to FIG. 2.

The refrigerator according to the present invention may include a timer 40 for measuring an interval of one hour. The timer 40 may be configured to measure an interval of one hour after a certain point of time and measure the next interval of one hour again. For example, the timer 40 may measure a plurality of intervals of one hour after power is applied to the refrigerator. Because the timer 40 also receives power immediately when power is applied to the refrigerator, a starting point of time of the timer 40 may not be additionally set or complicated constitution for controlling operation of the timer 40 may not be required. Information about the interval of one hour divided by the timer 40 may be transmitted to a control unit 100.

The refrigerator according to the present invention may include a door opening/closing sensor 50. The door opening/closing sensor 50 may sense opening and closing of the door and transmit related information to the control unit 100. When the door is opened, a light may be turned on in the storage compartment by the door opening/closing sensor 50.

The refrigerator according to the present invention may include a temperature sensor 60 for measuring the outside temperature. The temperature sensor 60 may be adopted or not depending on the varied embodiments of the present invention. In other words, in the case in which a temperature value measured by the temperature sensor 60 needs to be used, the temperature sensor 60 may be adopted, however, in the case in which a temperature value measured by the temperature sensor 60 does not need to be used, the temperature sensor 60 may not be adopted. Information about the temperature measured by the temperature sensor 60 may be transmitted to the control unit 100.

Information transmitted from the timer 40, the door opening/closing sensor 50 and the temperature sensor 60 may be stored in a storage unit 70. Sector units each having 24 sectors may be stored in the storage unit 70. Each of the sectors is defined as an interval of one hour by the control unit 100, and 24 sectors are consecutively arranged in each sector unit.

The refrigerator according to the present invention may include a compressor 80 which is controlled based on information transmitted to the control unit 100. The compressor 80 may compress the refrigerant to supply cool air to the storage compartments, and the temperature in the storage compartments may be adjusted according to the operation type of the compressor 80. In other words, if the compressor 80 is driven for a relatively long time or at a relatively high speed, a relatively large amount of cool air may be generated, which results in a relatively considerable drop in temperature in the storage compartments. On the other hand, if the compressor 80 is driven for a relatively short time or at a relatively low speed, a relatively small amount of cool air may be generated, which results in a relatively slight drop in temperature in the storage compartments.

Figure 3:
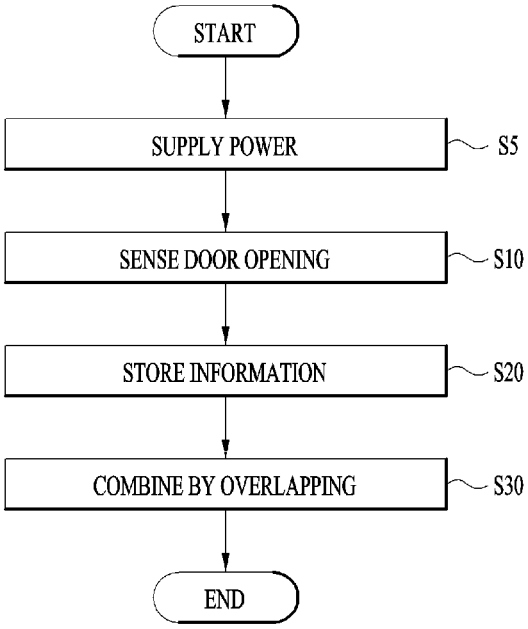
FIG. 3 is a control flowchart of a refrigerator according to one embodiment of the present invention.
Figure 4:
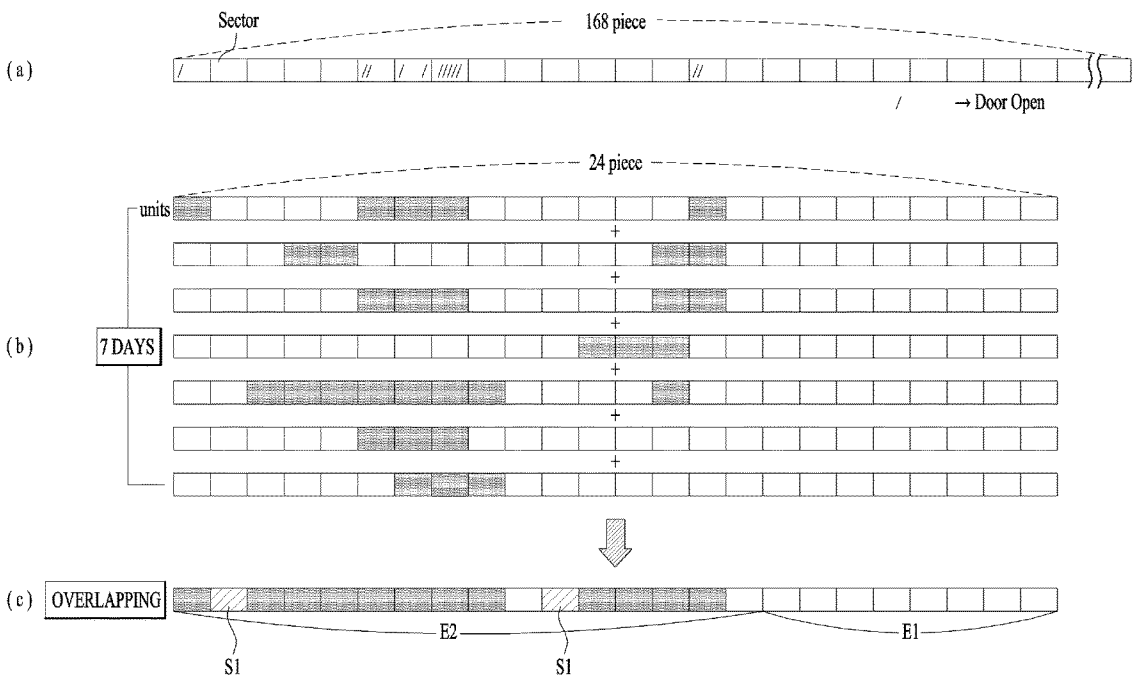
FIG. 4 is a view for explaining FIG. 3.

FIG. 3 is a control flowchart of the refrigerator according to one embodiment of the present invention, and FIG. 4 is a view for explaining FIG. 3. The present invention will now be described with reference to FIGS. 3 and 4.

First, power is supplied to the refrigerator at step S5. For example, a user may connect a power cable of the refrigerator to an external power source, or may push a power button of the refrigerator in the state which a power cable is connected to an external power source, thereby supplying power to the refrigerator.

If power is supplied to the refrigerator, the power may also be supplied to the timer 40, and the timer 40 may measure an interval of one hour. The interval of one hour measured by the timer 40 may define a sector. At this time, a unit time may be set to one hour.

The unit time is measured by the timer 40, and opening of the door may be sensed in each sector corresponding to the unit time for 168 hours at step S10.

Because each sector refers to one hour, a relative time may be measured from a point of time at which power is supplied to the refrigerator. However, because the refrigerator does not receive information about a current time from an external device or a user, information about an absolute time is not used.

As each sector is generated as shown in FIG. 4*a*, the door opening/closing sensor 50 may sense opening or closing of the door for one hour defined by the corresponding sector. At this time, information collected for 168 hours as shown in FIG. 4*a* may be stored at step S20.

In FIG. 4*a*, opening of the door is denoted by '/', and the door is opened in the first-generated sector (i.e., for the first one hour) after a point of time at which power is supplied to the refrigerator. A total of 168 sectors may be consecutively stored, however, illustration of sectors consecutively arranged after 24 sectors is omitted in FIG. 4*a*.

As shown in FIG. 4*b*, information stored by each unit time for 168 hours may be divided by an interval of 24 hours into 7 units. The 7 units may be arranged to overlap with each other, and may be combined into one unit at step S30.

A black-colored sector in one sector unit may refer to opening of the door in the corresponding sector, and a non-colored sector may refer to non-opening of the door in the corresponding sector.

The 7 units respectively storing door opening information collected for 24 hours may be stored in the storage unit 70. Therefore, the capacity occupied by the information in the storage unit 70 may be small.

The 7 units may overlap with each other by the same time zone and combined into one unit having 24 sectors, thereby estimating a refrigerator use pattern.

As shown in FIG. 4*c*, the refrigerator use pattern indicated by 24 sectors (one unit) may include information for controlling the refrigerator according to the use pattern by a user for one day, i.e., 24 hours. Because the starting point of time of the one unit is a point of time at which power is supplied to the refrigerator, the starting point of time may be diverse, for example, morning, afternoon, etc.

A process of overlapping the 7 units into one unit will be explained as follows. If the door is opened in at least one of the sectors of the same time zone, it may be determined that there is a high possibility of door opening in the corresponding time zone. Accordingly, if the door is opened in at least one of the sectors of the same time zone as shown in FIG. 4*b*, it may be predicted that the door will be opened in the corresponding time zone based on the refrigerator use pattern illustrated in FIG. 4*c*.

On the other hand, if the door is not opened in all the sectors of the same time zone, it may be determined that there is a low possibility of door opening in the corresponding time zone. Accordingly, if the door is not opened in all the sectors of the same time zone as shown in FIG. 4*b*, it may be predicted that the door will not be opened in the corresponding time zone based on the refrigerator use pattern illustrated in FIG. 4*c*.

Because only the door opening/closing data is processed when the 7 units overlap, data conversion may be easily achieved when combining the respective sectors.

A refrigerator operation mode for the next 24 hours may be determined using the refrigerator use pattern (one unit) which is data overlapped at step S30. In other words, the refrigerator operation mode may vary according to the prediction of door opening or closing in the corresponding sector.

The refrigerator operation mode may include a normal operation mode for maintaining the storage compartment at a first desired temperature, and a power-saving operation mode for maintaining the storage compartment at a second desired temperature which is higher than the first desired temperature. Especially, the first desired temperature may be an inner temperature of the storage compartment set by a user. In the case in which a user sets an inner temperature of the freezing compartment to −10° C. and an inner temperature of the refrigerating compartment to 3° C., each of the above temperatures set by a user may be the first desired temperature.

The second desired temperature may be set to be higher than the first desired temperature by a predetermined temperature, e.g., 0.5 to 2° C.

If there is a high possibility of door opening in each sector (black-colored sector) based on the refrigerator use pattern, the normal operation mode may be carried out to maintain the storage compartment at the first desired temperature. If a user opens the door, the possibility of outflow of the cool air from the storage compartment is high. Therefore, arbitrary increase in temperature of the storage compartment may cause undesired increase in temperature of food stored in the storage compartment. As a result, it is preferable to maintain the storage compartment at the first desired temperature set by a user.

On the other hand, if there is a low possibility of door opening in each sector (non-colored sector) based on the refrigerator use pattern, the power-saving operation mode may be carried out to maintain the storage compartment at the second desired temperature. If a user does not open the door, the possibility of outflow of the cool air from the storage compartment is low. Therefore, in spite of arbitrary increase in temperature of the storage compartment, undesired increase in temperature of food stored in the storage compartment may not occur. As a result, it is possible to maintain the storage compartment at the second desired temperature which is set to be higher than the first desired temperature set by a user. If the storage compartment is maintained at a relatively high temperature, energy consumption necessary to drive the compressor 80 may be reduced, and accordingly use of electricity by the refrigerator may also be reduced. Since the second desired temperature is higher than the first desired temperature corresponding to a temperature set by a user, a power-saving effect can be achieved.

The second desired temperature may be set to be higher than the first desired temperature by 0.5 to 2° C. For example, if the first desired temperature is 0° C., the second desired temperature may be 2° C. In the case of the refrigerating compartment, the second desired temperature may be set to 6° C.

In the estimated refrigerator use pattern illustrated in FIG. 4*c*, if a plurality of sectors (black-colored sectors) in which door opening is predicted are consecutively arranged, the second desired temperature in the sector (sector with oblique lines) positioned prior to the sectors in which door opening is predicted may be lowered below a predetermined temperature.

In other words, while the power-saving operation mode is carried out in the sectors in which door opening is not predicted in order to maintain the storage compartment at the second desired temperature, the storage compartment may be maintained at a certain temperature, which is slightly lower than the second desired temperature, in the sector (sector with oblique lines) positioned prior to the sectors in which door opening is predicted.

Since the corresponding sector (sector with oblique lines) refers to about one hour before the time zone in which a user is very likely to open the door, the storage compartment may be maintained at a temperature between the second desired temperature and the first desired temperature so as to prepare for occurrence of the sector in which a user is very likely to open the door.

Especially, if the time zones in which the door is opened are consecutively arranged in the aforementioned one unit, the refrigerator control temperature may be controlled below the temperature set by a user one hour before the time zone in which door opening is started. In other words, in the sector S1 positioned prior to the sector in which door opening is predicted, the temperature in the storage compartment may be lowered below the preset temperature in preparation for door opening, thereby enabling a user to recognize that the temperature in the storage compartment is sufficiently low.

In the sector with oblique lines, the storage compartment is maintained at a temperature between the second desired temperature and the first desired temperature, which may be referred to as a warm-up operation mode.

In the case in which door opening is not predicted in the consecutive sectors more than the predetermined number, it may be determined that the time zone corresponding to the sectors is nighttime, which is denoted by E1 in FIG. 4*c*. This is because the possibility that a user does not use the refrigerator in the nighttime is relatively high. By estimating the refrigerator use pattern, relative time information corresponding to the nighttime may be obtained.

In the sectors E1 corresponding to the nighttime, the power-saving operation mode is carried out, in which the second desired temperature may be raised above the predetermined temperature for the corresponding time. In other words, in the case in which the second desired temperature is set to 2° C., the second desired temperature may be raised to 3° C. because the possibility that a user does not open the door for a long time in the sectors E1 corresponding to the nighttime is high and thus the possibility that the temperature in the storage compartment rises due to door opening is low.

The predetermined number of the consecutive sectors in which door opening is not predicted may be arbitrarily set by a user or a refrigerator manufacturer. For example, the predetermined number may be 3 or more.

Especially, if the time zones in which the door is not opened are consecutively arranged in the aforementioned one unit, the refrigerating compartment control temperature may be controlled to 6° C. or more after the first time zone in which the door is not opened. This is because noise generated by driving the compressor in the nighttime may disturb a user's sleep. As described above, the present invention is devised in consideration of both food storage in the refrigerator and noise generated during the refrigerator operation.

In the case in which door opening is predicted in the consecutive sectors more than the predetermined number, it may be determined that the time zone corresponding to the sectors is daytime, which is denoted by E2 in FIG. 4*c*. This is because the possibility that a user uses the refrigerator in the daytime is relatively high. By estimating the refrigerator use pattern, relative time information corresponding to the daytime may be obtained.

In the sectors E2 corresponding to the daytime, the normal operation mode may be carried out in the sectors in which door opening is predicted, however, the power-saving operation mode may be carried out in the sectors in which door opening is not predicted. In such a power-saving operation mode, the storage compartment is not maintained at the predetermined second desired temperature, but at a certain temperature lower than the second desired temperature. Because the possibility that a user opens the door in the daytime is high and thus the possibility that the temperature in the storage compartment rises due to door opening is high, the storage compartment is maintained at a temperature lower than the predetermined temperature even while the power-saving operation mode is carried out, thereby preventing the temperature of food from rising due to sudden door opening.

Meanwhile, in the sectors corresponding to the daytime in which door opening is predicted, the temperature in the storage compartment may be controlled so that the first desired temperature set by a user is maintained.

The refrigerator use pattern may be estimated from the recently stored 7 sector units. In other words, opening or closing of the door for the next 24 hours may be predicted using the sector information stored for the last 168 hours. Since the storage unit 70 stores only the data related to the 7 sector units, the capacity occupied by the data in the storage unit 70 may be small. In this case, the control unit 100 may replace the oldest stored sector unit of the recent 7 sector units by the most recently stored sector unit.

Typically, people have a routine life pattern centered on 7 days, i.e., a week. Therefore, the refrigerator use pattern of a user may be predicted using information collected for a week. A user opens the door periodically for 7 days. If the temperature in the storage compartment is adjusted based on the 24 sectors, i.e., the data stored for one day, the possibility of mistakenly estimating the refrigerator use pattern is high. On the other hand, if using the data stored for more than 7 days, the amount of data may become unnecessarily large, and lots of efforts may be made to process information and combine the large amount of data. According to the present invention, the refrigerator use pattern of a user may be reasonably and easily estimated using information stored for 7 days.

The control unit 100 may control the temperature in the storage compartment using the latest information about the refrigerator use pattern estimated by combining the information of the recent 7 sector units.

Figure 5:
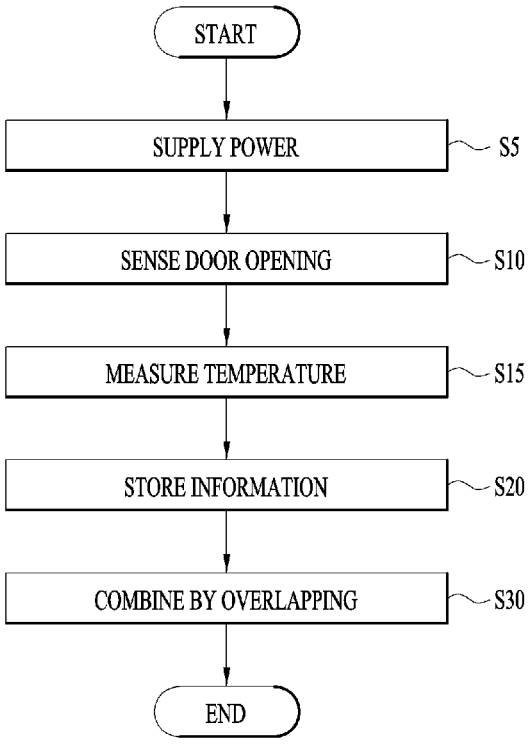
FIG. 5 is a control flowchart of a refrigerator according to another embodiment of the present invention.

FIG. 5 is a control flowchart of a refrigerator according to another embodiment of the present invention. The present invention will now be described with reference to FIG. 5.

The embodiment illustrated in FIG. 5 is the same as the previous embodiment of FIG. 3 except that a process of controlling the temperature in the storage compartment using information about the temperature measured by the temperature sensor 60 is added. Therefore, only a temperature measurement process will be additionally explained.

A control method illustrated in FIG. 5 further includes measuring a temperature of the atmosphere at step S15.

If the temperature measured at step S15 is 30° C. or more for a predetermined time, the second desired temperature may be lowered below the predetermined temperature. If the temperature of the atmosphere is 30° C. or more for a predetermined time, it may be guessed that the season in which the predicted refrigerator use pattern is used is summer. The reference temperature, 30° C., may be varied according to an average temperature of summer in the corresponding area, or may be set to a specific value.

Typically, the temperature of the atmosphere of summer is higher than that of other seasons, and thus food stored in the storage compartment may easily go bad. Even when the power-saving operation mode is carried out, the second desired temperature is maintained lower than the predetermined temperature, thereby preventing increase in possibility that food goes bad due to the power-saving operation mode.

Because the temperature of the daytime is higher than that of the nighttime in summer, it may be determined whether it is summer using the temperature measured in the sectors corresponding to the daytime. In the case in which door opening is predicted in the consecutive sectors more than the predetermined number, it may be determined that the time zone of the sectors disposed adjacent to the corresponding sectors is the daytime. In the process of measuring the temperature of the atmosphere at step S15, the temperature measured in the sectors corresponding to the daytime may be compared with the predetermined temperature.

On the other hand, if the temperature measured at step S15 is 20° C. or less for a predetermined time, the second desired temperature may be raised above the predetermined temperature.

If the temperature of the atmosphere is 20° C. or less for a predetermined time, it may be guessed that the season in which the predicted refrigerator use pattern is used is winter. Typically, the temperature in winter is lower than that in other seasons. The reference temperature, 20° C., may be varied according to a climate or seasonal characteristic of the corresponding area.

By using the information about door opening and the information about the temperature of the atmosphere measured by the temperature sensor 60, information about the season may be obtained. Based on the estimated information about the season, the temperature in the storage compartment may be controlled.

It is preferable to raise the temperature in the storage compartment in order to reduce power consumption of the refrigerator. According to the present invention, a pattern of raising the temperature in the storage compartment may be changed based on the season information estimated from the refrigerator use pattern of a user. Because the temperature of the atmosphere is relatively high in summer, sudden door opening may cause a sharp rise in temperature of food, resulting in high possibility of deterioration of freshness. Meanwhile, because the temperature of the atmosphere is relatively low in winter, even when sudden door opening occurs, there is a low possibility of food going bad due to a sharp rise in temperature.

Figure 6:
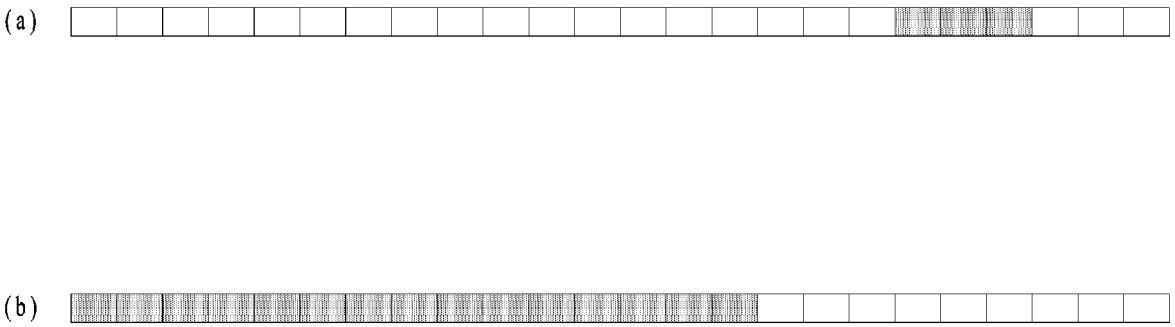
FIG. 6 is a view for explaining a control method of a refrigerator according to a further embodiment of the present invention.

FIG. 6 is a view for explaining a control method of a refrigerator according to a further embodiment of the present invention. The present invention will now be described with reference to FIG. 6.

According to the embodiment illustrated in FIG. 6, the rate of use is estimated using the information about the combined refrigerator use pattern (one unit) depicted in FIG. 4*c*, and accordingly the temperature in the storage compartment is controlled.

In the process of estimating the refrigerator use pattern, if a ratio of the sectors in which door opening is predicted is less than a predetermined value, the second desired temperature may be raised above the predetermined temperature. In other words, if the frequency of use is relatively low, it may be determined that there is a low possibility that a user opens the door suddenly, and thus the power-saving operation mode may be carried out such that the second desired temperature is maintained higher than the predetermined temperature, thereby reducing power consumption of the refrigerator.

As shown in FIG. 6*a*, in the case in which a user opens the door in 3 sectors of a total of 24 sectors, the number of the sectors (i.e., 3 sectors) is less than a predetermined value (e.g., 5 sectors of 24 sectors), and accordingly it may be determined that the frequency of opening the door is low. As a result, in the sectors in which door opening is not predicted, the storage compartment may be maintained at a temperature higher than the predetermined second desired temperature.

On the other hand, in the process of estimating the refrigerator use pattern, if a ratio of the sectors in which door opening is predicted is greater than a predetermined value, the second desired temperature may be lowered below the predetermined temperature. In other words, if the frequency of use is relatively high, it may be determined that there is a high possibility that a user opens the door suddenly, and thus the power-saving operation mode may be carried out such that the second desired temperature is maintained lower than the predetermined temperature, thereby preventing sudden rise in temperature in the storage compartment.

As shown in FIG. 6*b*, in the case in which a user opens the door in 15 sectors of a total of 24 sectors, the number of the sectors (i.e., 15 sectors) is greater than a predetermined value (e.g., 12 sectors of 24 sectors), and accordingly it may be determined that the frequency of opening the door is high. As a result, in the sectors in which door opening is not predicted, the storage compartment may be maintained at a temperature lower than the predetermined second desired temperature.

At this time, since the above temperature lower than the predetermined second desired temperature is set by a user and is higher than the first desired temperature used in the normal operation mode, power consumption of the refrigerator may be reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a refrigerator comprising:

measuring by a timer a plurality of time unit intervals; sensing a door opening/closing by a door/closing sensor;

storing in a storage unit information corresponding to a number of door opening/closing for each time unit interval during the plurality of time unit intervals measured by the timer; and dividing by a control unit the stored storage unit information into a plurality of units and combining the plurality of units into one unit by overlapping the plurality of units, wherein a time zone in which door opening/closing does not occur is determined by the control unit by checking the plurality of time unit intervals in the one unit, and controlling the refrigerator temperature is maintained higher than a temperature set by a user in the time zone in which door opening/closing does not occur, wherein each of the plurality of time unit intervals is defined by a sector having an interval of one hour, with respect to a sector in which door opening/closing does not occur in the one unit, the control unit determines that there is a low possibility of door opening/closing in the corresponding time zone, and with respect to a sector in which door opening/closing occurs in the one unit, the control unit determines that there is a high possibility of door opening/closing in the corresponding time zone, wherein a storage compartment is maintained at a first desired temperature in the sector in which door opening/closing is determined, and the storage compartment is maintained at a second desired temperature higher than the first desired temperature in the sector in which door opening/closing is not determined, wherein, if a ratio of the sectors in which door opening/closing is determined by the control unit to be greater than a predetermined value, the control unit lowers the second desired temperature below a predetermined temperature.

2. The method according to claim 1, wherein the plurality of time unit intervals correspond to 168 hours, wherein the control unit divides the 168 hours by an interval of 24 hours to form a plurality of units corresponding to 7 units.

3. The method according to claim 1, wherein, if the time zone in which door opening/closing occurs in predetermined number of consecutive time unit intervals in the plurality of time unit intervals arranged in the one unit, the control unit controls the refrigerator temperature to be below the temperature set by the user before the time zone in which door opening/closing is started.

4. The method according to claim 1, wherein, if the time zone in which door opening/closing does not occur in predetermined number of consecutive time unit intervals in the plurality of time unit intervals arranged in the one unit, the control unit controls the refrigerator temperature to be above the temperature set by the user after a start of the time zone in which door opening/closing does not occur.

5. The method according to claim 4, wherein, if the time zone in which door opening does not occur in the predetermined number of consecutive time unit intervals in the plurality of time unit intervals arranged in the one unit, the control unit controls a refrigerating compartment temperature to 6° C. or more after the start of the time zone in which door opening/closing does not occur.

6. The method according to claim 1, further comprising:

measuring by a temperature sensor a temperature of an atmosphere, wherein, if the measured temperature of the atmosphere is 30° C. or more for a predetermined time, the control unit controls the second desired temperature to be lowered below a predetermined temperature.

7. The method according to claim 6, wherein, if door opening/closing is determined by the control unit in consecutive sectors that is more than a predetermined number, the control unit determines that a time zone corresponding to the consecutive sectors is daytime, and the control unit compares the temperature of the atmosphere measured by the temperature sensor in the sectors corresponding to the daytime with the predetermined temperature.

8. The method according to claim 1, further comprising:

measuring by a temperature sensor a temperature of an atmosphere, wherein, if the measured temperature of the atmosphere is 20° C. or less for a predetermined time, the control unit raises the second desired temperature above a predetermined temperature.

9. The method according to claim 1, wherein, if a ratio of the sectors in which door opening/closing is determined by the control unit to be less than a predetermined value, the control unit raises the second desired temperature above a predetermined temperature.

10. The method according to claim 1, wherein the first desired temperature is an inner temperature of the storage compartment set by the user.

11. A refrigerator comprising:

a timer for measuring a plurality of time unit intervals;

a door opening/closing sensor for sensing opening/closing of a door;

a storage unit for storing information corresponding to a number of door opening/closing for each time unit interval during the plurality of time unit intervals measured by the timer; and a control unit for dividing the stored information into a plurality of units, combining the plurality of units into one unit by overlapping the plurality of units, determining a time zone in which door opening/closing does not occur by checking the plurality of time unit intervals in the one unit, and controlling a refrigerator temperature to be maintained higher than a temperature set by a user in the time zone in which door opening/closing does not occur, wherein each of the plurality of time unit intervals is defined by a sector having an interval of one hour, with respect to a sector in which door opening/closing does not occur in the one unit, the control unit determines that there is a low possibility of door opening/closing in the corresponding time zone, and with respect to a sector in which door opening/closing occurs in the one unit, the control unit determines that there is a high possibility of door opening/closing in the corresponding time zone, and wherein, if door opening/closing is not determined in consecutive sectors more than a predetermined number, the control unit determines that time zone corresponding to the consecutive sectors is nighttime.

12. The refrigerator according to claim 11, wherein each of the plurality of time unit intervals corresponds to one hour, and the plurality of time unit intervals correspond to 168 hours, wherein the control unit divides the 168 hours by an interval of 24 hours to form a plurality of units corresponding to 7 units.

13. The refrigerator according to claim 11, wherein, if the time zone in which door opening/closing occurs in predetermined number of consecutive time unit intervals in the plurality of time unit intervals arranged in the one unit, the control unit controls the refrigerator temperature to be below the temperature set by the user before the time zone in which door opening/closing is started.

14. The refrigerator according to claim 11, wherein, if the time zone in which door opening/closing does not occur in predetermined number of consecutive time unit intervals in the plurality of time unit intervals arranged in the one unit, the control unit controls the refrigerator temperature to be above the temperature set by the user after a start of the time zone in which door opening/closing does not occur.

15. The refrigerator according to claim 14, wherein, if the time zone in which door opening/closing does not occur in predetermined number of consecutive time unit intervals in the plurality of time unit intervals arranged in the one unit, the control unit controls a refrigerating compartment temperature to be 6° C. or more after the start of the time zone in which door opening/closing does not occur.

16. The refrigerator according to claim 11, wherein a storage compartment is maintained at a first desired temperature in the sector in which door opening/closing is determined, and the storage compartment is maintained at a second desired temperature higher than the first desired temperature in the sector in which door opening/closing is not determined.

17. The refrigerator according to claim 11, wherein the control unit raises the second desired temperature above a predetermined temperature during the time zone corresponding to the consecutive sectors.

* * * * *